United States Patent [19]

Daubendiek et al.

[11] Patent Number: 4,914,014

[45] Date of Patent: Apr. 3, 1990

[54] NUCLEATION OF TABULAR GRAIN EMULSIONS AT HIGH PBR

[75] Inventors: Richard L. Daubendiek; Timothy R. Gersey; Gary S. Proehl, all of Rochester, N.Y.

[73] Assignee: Eastman Kodak Company, Rochester, N.Y.

[21] Appl. No.: 214,267

[22] Filed: Jun. 30, 1988

[51] Int. Cl.[4] ..... G03C 1/02

[52] U.S. Cl. ..... 430/569; 430/567

[58] Field of Search ..... 430/567, 569

[56] References Cited

U.S. PATENT DOCUMENTS

| | | | |
|---|---|---|---|
| 4,301,241 | 11/1981 | Saito | 430/569 |
| 4,414,310 | 11/1983 | Daubendiek et al. | 430/567 |
| 4,434,226 | 2/1984 | Wilgus et al. | 430/567 |
| 4,439,520 | 3/1984 | Kofron et al. | 430/434 |
| 4,713,320 | 12/1987 | Maskasky et al. | 430/569 |
| 4,797,354 | 1/1989 | Saitou et al. | 430/567 |

FOREIGN PATENT DOCUMENTS

| | | |
|---|---|---|
| 3644159A1 | 7/1987 | Fed. Rep. of Germany . |
| 3707135A1 | 9/1987 | Fed. Rep. of Germany . |

*Primary Examiner*—Paul R. Michl
*Assistant Examiner*—Janet C. Baxter
*Attorney, Agent, or Firm*—Carl O. Thomas

[57] ABSTRACT

The present invention is directed to a process of precipitating for use in photography a thin tabular grain silver bromide or bromoiodide emulsion within a novel range of low bromide ion concentrations (high pBr levels) at the nucleation stage. A variety of advantages can be realized, including thinner and/or larger diameter tabular grains and novel tabular grain forms.

23 Claims, 1 Drawing Sheet

NUCLEATION OF TABULAR GRAIN EMULSIONS AT HIGH PBR

FIELD OF THE INVENTION

This invention relates to processes for the preparation of radiation-sensitive silver bromide and silver bromoiodide emulsions useful in photography.

BACKGROUND OF THE INVENTION

The highest speed and therefore most commonly employed photographic elements are those which contain a radiation-sensitive silver bromide or bromoiodide emulsion layer coated on a support. Although other ingredients can be present, the essential components of the emulsion layer are radiation-sensitive silver bromide microcrystals, optionally containing iodide, commonly referred to as grains, which form the discreet phase of the photographic emulsion, and a vehicle, which forms the continuous phase of the photographic emulsion.

Interest in silver halide photography has recently focused on tabular grain emulsions, particularly thin intermediate and high aspect ratio tabular grain emulsions. It has been shown that these emulsions can produce a variety of photographic advantages, including increased sharpness, improved speed-granularity relationships, increased blue and minus-blue speed separations, more rapid developability, higher silver covering power when fully forehardened, reduced crossover in spectrally sensitized dual coated (also referred to as two sided or Duplitized ®) radiographic formats, and various imaging advantages in dye image transfer film units. Research Disclosure, Vol. 225, Jan. 1983, Item 22534, is considered representative of these teachings. *Research Disclosure* is published by Kenneth Mason Publications, Ltd., Emsworth, Hampshire P010 7DD, England.

In precipitating thin tabular grain silver bromide and bromoiodide emulsions, it is recognized that the bromide ion concentration in solution at the stage of grain formation must be maintained within limits to achieve the desired tabularity of grains. As grain growth continues, the bromide ion concentration in solution becomes progressively less influential on the grain shape ultimately achieved.

For example, Wilgus et al U.S. Pat. No. 4,434,226 teaches the precipitation of high aspect ratio tabular grain silver bromoiodide emulsions at bromide ion concentrations in the pBr range of from 0.6 to 1.6 during grain nucleation, with the pBr range being expanded to 0.6 to 2.2 during subsequent grain growth. Kofron et al U.S. Pat. No. 4,439,520 extends these teachings to the precipitation of high aspect ratio tabular grain silver bromide emulsions. pBr is defined as the negative log of the solution bromide ion concentration.

Daubendiek et al U.S. Pat. No. 4,414,310 describes a process for the preparation of high aspect ratio silver bromoiodide emulsions under pBr conditions not exceeding the value of 1.64 during grain nucleation.

According to Maskasky U.S. Pat. No. 4,713,320, in the preparation of high aspect ratio silver halide emulsions the useful pBr range during nucleation can be extended to a value of 2.4 when the precipitation of the tabular silver bromide or bromoiodide grains occurs in the presence of gelatino-peptizer containing less than 30 micromoles of methionine (e.g., oxidized gelatin) per gram.

Sugimoto German OLS 3,644,159 A1 (published July 2, 1987, priority Japan Dec. 12, 1985) discloses a process of preparing tabular grain silver bromoiodide emulsions in which the iodide ion concentration in the reaction vessel is maintained within a mathematically stated relationship to the bromide ion concentration. In some of the examples the pBr during nucleating is greater than 2.3.

Saitou et al German OLS 3,707,135 A1 (published Sept. 10, 1987, priority Japan Mar. 6, 1986) discloses tabular grain emulsions in which hexagon projected area tabular grains having two parallel twin planes and a neighboring edge ratio of 2:1 or less account for at least 70 percent of the total grain projected area and are monodispersed. Some of the examples of silver bromide tabular grain emulsions are prepared with a pBr during nucleation of greater than 2.3.

M. J. Harding, "The Application of Calculations of Complex Solubility to the Interpretation of Crystal Grown Phenomena in Silver Halide Emulsions", *The Journal of Photographic Science,* Vol. 27, 1979, pp. 1-12, plots the log of silver bromide solubility versus pBr, but was unable to correlate crystal habits observed with solution species.

SUMMARY OF THE INVENTION

In one aspect, this invention is directed to a process for the preparation within a reaction vessel of a thin tabular grain silver bromide or bromoiodide emulsion wherein tabular grains having a thickness of less than 0.2 μm exhibit an average aspect ratio of greater than 5:1 and account for at least 50 percent of total grain projected area of the emulsion. The process comprises introducing into the reaction vessel an aqueous dispersing medium and silver, bromide, and, optionally, iodide ions, and maintaining pBr values within the reaction vessel during grain nucleation and growth that favors the formation and growth of tabular grains. The process is characterized in that pBr values within the reaction vessel of at least 2.3 are maintained during grain nucleation, with the proviso that when gelatino-peptizer which has a methionine content of less than 30 micromoles per gram is present in the dispersing medium during grain nucleation, the pBr within the reaction vessel is maintained at a value greater than 2.4.

In more specific aspects, this invention is directed to a process as described above wherein at least one of the following additional conditions are satisfied:

(a) the pBr within the reaction vessel is maintained in a range of from 2.3 to 9.5, preferably from 2.3 to 8.0, and most preferably from 2.3 to 6.5 at the time that tabular grains are being formed;

(b) at the time that tabular grains are being formed, a gelatino-peptizer is present in a concentration of from 0 to 45 g, preferably from 0 to 20 g, and most preferably from 0 to 10 g per liter of vessel content;

(c) at the time that tabular grains are being formed, the pH in the reaction vessel is maintained at a value ranging from about 0.8 to 10.0, preferably from about 1.2 to 8.5, and most preferably from about 1.6 to 7.0.

(d) grain growth is carried out in the presence of a gelatino-peptizer;

(e) grain formation and/or growth is carried out in the presence of gelatino-peptizer containing less than 30, preferably less than 15, micromoles of methionine per gram;

(f) at the time that tabular grains are being formed, the level of iodide, relative to precipitated silver ions, is less than 42, preferably less than 32, and most preferably less than 24 mole percent;

(g) the molar ratio of reactant flow rates during grain nucleation to reactant flow rates at the start of grain growth ranges from about 0.5:1 to 100:1, preferably from about 1:1 to 50:1, and most preferably from about 1.5:1 to 15:1;

(h) during at least an early portion of the growth stage the pBr within the reaction vessel is maintained at a value ranging from 0.6 to 4.5, preferably 0.85 to 3.3, and most preferably from 1.0 to 2.75.

In yet another aspect, this invention is directed to a photographic element comprises of a support and at least one radiation-sensitive emulsion layer comprises of a thin tabular grain silver halide emulsion prepared by the process according to this invention.

It is an advantage of the present invention that thin, high aspect ratio tabular grain silver bromide and silver bromoiodide can be prepared within different pBr ranges than have been employed in the past, thereby offering greater choice and control of tabular grain emulsion characteristics. Thus, the present invention makes possible a wider range of precipitation conditions than have previously existed.

DESCRIPTION OF PREFERRED EMBODIMENTS

Figure 1:
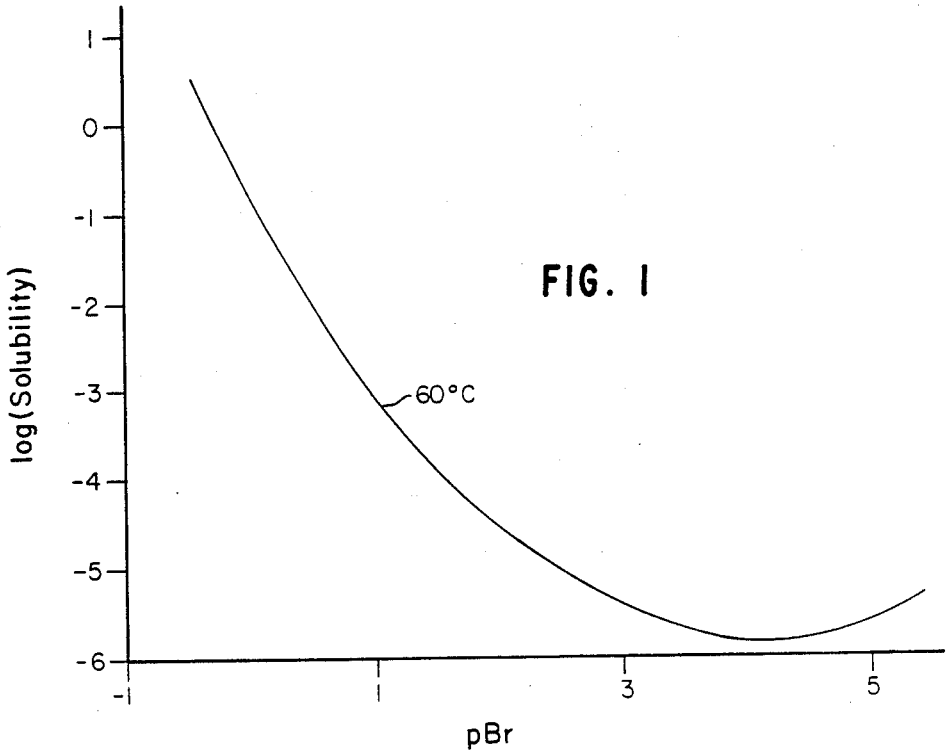
FIGS. 1 and 2 are plots of the log of solubility of silver bromide (expressed in moles per liter) versus pBr at 60° and 35° C., respectively.

In the context of the preparation of emulsions the term "nucleation" refers to that stage of the precipitation or preparation process in which stable new silver bromide or bromoiodide grains are being formed or otherwise introduced into the reaction vessel. References to "forming grains" or "grain formation" are to be understood as being directed to the nucleation stage of precipitation. The term "growth" refers to that portion of the precipitation or preparation process in which existing silver bromide or bromoiodide grains are being increased in size without an additional stable grain population being introduced or formed.

It has been discovered that the advantages identified above can be realized by modifying known precipitation procedures in which silver, bromide, and, optionally, iodide ions are concurrently introduced into a reaction vessel to prepare a thin tabular grain emulsion. Specifically, it has been discovered that these advantages can be realized by maintaining the pBr within the reaction vessel above conventional levels, these levels ranging up to 9.5, preferably up to 8.0, and most preferably up to 6.5 at the time that tabular grains are being formed, i.e., during grain nucleation. The minimum pBr levels contemplated are generally at least 2.3, but when a gelatino-peptizer containing low levels of methionine (less than 30 micromoles per gram) is present during nucleation, the minimum pBr is greater than 2.4. Thus, this invention makes possible for the first time the nucleation of thin, high aspect ratio tabular grain silver bromide and bromoiodide emulsions at a pBr value not heretofore recognized to be useful in precipitating thin, tabular grain emulsions.

Variables which have been found to favor tabular grain nucleation at high pBr values include: low levels of gelatino-peptizer (including the absence of gelatino-peptizer), low pH values (when gelatino-peptizer is present), gelatino-peptizer with less than 30 microseconds of methionine per gram (e.g., oxidized gelatin), iodide in the halide reactant solution used for nucleation (but concentrations less than those which will produce uncontrolled multiple twinning), high reactant addition rates, a high ratio of reactant flow rates during nucleation to reactant flow rates at the start of grain growth, and low levels of silver halide solvents (ripeners) such as ammonia, thioethers, and the like. Any one or all of these variables may be adjusted to achieve nucleation of tabular crystals at a given pBr value within the elevated pBr ranges specified herein.

During nucleation the aim is to achieve a high rate of silver bromide or bromoiodide precipitation from solution by increasing the macroscopic supersaturation of the system, thereby increasing the propensity for twin plane formation. This is accomplished by employing the higher pBr levels required by this process and selection of precipitation conditions to satisfy one or more of the other parameters indicated above.

Once a higher pBr level has been selected, the most direct way of increasing supersaturation is to increase the rate of addition of the silver salt to the reaction vessel. Since there is an excess of halide ion present in the reaction vessel, halide salt addition, though in most instances preferred, is not required.

Gelatin has the capability of increasing the solubility of silver bromide, but at pBr levels which are conventionally employed for the preparation of tabular grain emulsions the solubilizing effects of gelatino-peptizer are so small that they are generally ignored. Within the higher pBr ranges of contemplated the presence of gelatino-peptizer can to an increased degree increase silver bromide solubility. Therefore, withholding gelatino-peptizer from the reaction vessel until the grains have reached a size sufficient to require a peptizer is another technique for increasing supersaturation. When gelatino-peptizer is present, limiting the gelatino-peptizer concentration, employing lower pH levels, and choosing gelatino-peptizer with lower levels of methionine can contribute to increasing supersaturation.

Although there is no intention of being bound to any particular theory to explain why adjustments of the nucleation stage as proposed are effective to produce thin tabular grain emulsions, it is recognized that to the extent a system is driven toward supersaturation it is also being driven away from equilibrium. It is also generally accepted that parallel twin planes produce sites at which accelerated rates of silver halide deposition can occur. Viewing supersaturation as a stress placed on the system, it is believed that the grain nuclei are induced by supersaturation to relieve this stress by twinning to a greater degree than would otherwise occur. Thus, a higher proportion of twinned grain nuclei are produced during the nucleation stage of precipitation. This can be directly translated into an increase in the percentage of the total grain projected area accounted for by thin tabular grains at the conclusion of the precipitation process.

Once the relationship between supersaturation and twin plane formation is appreciated, it is also apparent that the addition of iodide during nucleation can also facilitate the formation of tabular grains. Since silver iodide has a solubility approximately two orders of magnitude lower than that of silver bromide, the presence of iodide ions in the reaction vessel has the effect of significantly increasing supersaturation at pBr values of 3 or greater. Tabular grain formation is facilitated by moderate levels of iodide, but excessive levels of iodide that lead to uncontrolled multiple twinning are not useful, since only parallel twin planes contribute to the formation of tabular grains.

Modification of the growth stage of precipitation is not required to obtain tabular grain emulsions according to the process of the invention. That is, conventional growth stage procedures for producing thin, tabular grain emulsions are compatible with the nucleation stage procedures discussed above. However, the growth stage can be and preferably is adjusted to increase the propensity toward producing an emulsion having a high proportion of thin tabular grains. The strategies herein suggested for use in the growth stage for increasing the proportion of thin, tabular grains are in some instances similar to those employed in the nucleation stage and in some respects directly contrary.

Whereas in the nucleation stage the aim is to induce on a macroscopic scale supersaturation stress and thereby elevate the incidence of twinning, the aim in the growth stage is to slow the rate of silver bromide or bomoiodide deposition per unit of grain surface area. Slowing the deposition rate per unit of grain area increased the propensity for deposition to occur at the edges of the grains containing two or more parallel twin planes. These twinned grains are generally recognized to grow laterally into thin, tabular grains at an accelerated rate relative to the remaining grains lacking two or more parallel twin planes. Relieving supersaturation stress sufficiently to allow ions to seek the most favorable sites for deposition maximizes the preferential growth of the tabular grains. In other words, preferred growth stage pBr values are lower than those employed during the nucleation stage—e.g., preferably within the conventional ranges of from 0.6 to 2.3. However, elevation of the pBr values up to and including the pBr ranges employed during nucleation can be tolerated for at least a portion of the growth stage. For example, when a tabular grain population is being grown that is well below maximum acceptable grain thickness levels, increasing pBr levels toward the end of precipitation to permit other operations to be performed can be tolerated, since precipitation is terminated while the tabular grains are still within acceptable thicknesses.

The rate of silver ion addition during the growth stage is preferably maintained lower than during the nucleation stage. One convenient way of expressing this relationship is in terms of the ratio of nucleation stage rate of silver ion addition to the initial growth stage rate of silver ion addition. As is well recognized in the art, as the growth stage continues the absolute value of grain surface area increases permitting the final growth stage rate of silver ion addition to exceed the highest rates of silver ion addition during the nucleation stage.

The management of gelatino-peptizer during the growth stage can follow conventional practices, but is preferably similar to that during the nucleation stage, albeit for different reasons. In the nucleation stage, the reason for omitting or limiting the presence of gelatino-peptizer is to increase supersaturaton. During the growth stage it might then be assumed that elevating gelatino-peptizer levels, since this reduces supersaturation would be helpful. In fact, any positive effect by the gelatino-peptizer in the growth stage in relieving supersaturation is more than offset by its stabilizing action on grains lacking twin planes. Since grains which contain two or more twin planes (thin tabular grains) grow faster than the remaining grains (e.g., nontabular grains), sufficient size disparities in grains of the respective grain populations occur to favor dissolution of the smaller nontabular grains by Ostwald ripening followed by redeposition of the ions from solution onto the edges of the thin tabular grains. The gelatino-peptizer which surrounds the nontabular grains can retard their dissolution. Maintaining gelatino-peptizer levels during the growth stage at the minimum level required to avoid grain coagulation up to a level of about 3 percent by weight of the dispersing medium in the reaction vessel is a preferred approach for permitting maximum ripening removal of nontabular grains. Similarly maintaining low pH levels and employing gelatino-peptizer containing low levels of methionine, as indicated above, are also conducive to attaining the highest proportion of thin, tabular grains in the emulsion during the growth stage of precipitation.

Figure 2:
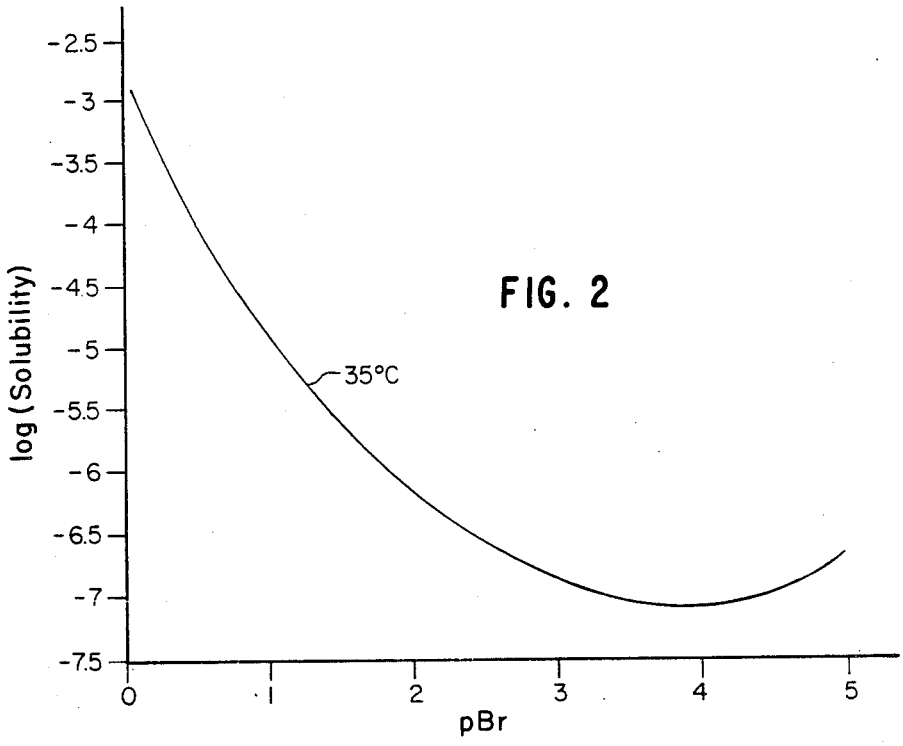

The reason high nucleation pBr values can result in thinner tabular crystals is evident from FIGS. 1 and 2, from published data ["Basic Crystallization Processes in Silver Halide Precipitation", J. S. Wey, in Preparation and Properties of Solid State Materials, Vol. 6 (W. R. Wilcox, Ed.), Marcel Dekker, New York, 1981, Ch. 2. First, FIGS. 1 and 2 illustrate the dependence of AgBr solubility on pBr. These curves have been calculated in a manner similar to that described by J. S. Wey, "Basic Crystallization Processes in Silver Halide Precipitation", J. S. Wey, in Preparation and Properties of Solid State Materials, Vol. 6 (W. R. Wilcox, Ed.), Marcel Dekker, New York, 1981, Ch. 2] for the solubility product constant and for dissociation constants for $AgBr_n^{-(n-1)}$ complexes. Note that the highest pBr previously described (pBr=2.4) for nucleation of tabular grain emulsions still corresponds to a solubility that is nearly an order of magnitude above the minimum; this is illustrated for both 35° C. and 60° C. and is also approximately true for all other temperatures that are of interest for precipitation. Second, published data indicate that nucleus size decreases with decreased solubility (See, for example, R. L. Daubendiek, Papers from the 1978 International Congress of Photographic Science, p. 140.) Third, the morphology of tabular crystals results from predominantly two-dimensional growth: Subsequent to nucleation, most new material is added to crystal edges and relatively less is added to faces, so that ultimate thickness depends on nucleus size before such two-dimensional growth takes place. It follows that if tabular grain nucleation could be made to occur near solubility minimum such as are illustrated in FIGS. 1 and 2 rather than at pBr of 2.4 or less, then thinner tabular crystals should result.

FIGS. 1 and 2 AgBr also show that solubility increases with increasing pBr once values higher than those corresponding to the minima are encountered. Therefore nucleus size is not expected to decrease monotonically with increasing pBr. Even in this pBr region (where tabular grain thickness may be no different from that observed for pBr ranges described in previous patents) nucleation at high pBr can still provide advantages because photographic responses such as speed, contrast, development rate, and granularity depend on emulsion pBr history.

The thin tabular grain emulsions of this invention can be prepared by incorporating one or more of the features discussed above in any conventional process for preparing thin tabular grain silver bromide or bromoiodide emulsions. For example, it is specifically contemplated to prepare thin tabular grain emulsions according to this invention by modifying in the manner described above the teachings of Wilgus et al U.S. Pat. No. 4,434,226; Kofron et al U.S. Pat. No. 4,439,520; Daubendiek et al U.S. Pat. No. 4,414,310; Abbot et al U.S. Pat. Nos. 4,425,425 and 4,425,426; Solberg et al U.S. Pat. No. 4,433,048; Dickerson U.S. Pat. No. 4,414,304; Jones et al U.S. Pat. No. 4,478,929; Maskasky U.S. Pat. No. 4,435,501; and *Research Disclosure,* Vol. 225, Jan. 1983, Item 22534, and Vol. 232, Aug. 1983, Item 23206; each of which are incorporated by reference.

While any conventional hydrophilic colloid peptizer can be employed in the practice of this invention, preferred peptizers for use in the practice of this invention are gelatino-peptizers—e.g., gelatin and modified gelatin (also referred to as gelatin derivatives). Useful hydrophilic colloid peptizers including gelatino-peptizers are disclosed in *Research Disclosure,* Vol. 176, Dec. 1978, Item 17643, IX Vehicles and vehicle extenders, Section A, here incorporated by reference. Of the various modified forms of gelatin, acetylated gelatin and phthalated gelatin constitute preferred gelatin derivatives. Specific useful forms of gelatin and gelatin derivatives can be chosen from among those disclosed by Yutzy et al U.S. Pat. Nos. 2,614,928 and 2,614,929; Lowe et al U.S. Pat. No. 2,614,930 and 2,614,931; Gates U.S. Pat. No. 2,787,545 and 2,956,880; Ryan U.S. Pat. No. 3,186,846; Dersch et al U.S. Pat. No. 3,436,220; Luciani et al U.K. Pat. No. 1,186,790; and Maskasky 4,713,320.

Precipitations according to the invention concurrently introduce into a reaction vessel silver, bromide, and, optionally, iodide ions to precipitate the desired thin tabular grain silver bromide or bromoiodide emulsion. Since an excess of halide ion is initially present in the reaction vessel, silver ion can initially be run into the reaction vessel alone at the outset of the nucleation stage or during the entire nucleation stage of precipitation. The reaction vessel initially contains water as a dispersing medium. A relatively small amount of bromide ion is typically introduced into the reaction vessel to produce the desired initial pBr. Since very small grains can be held in suspension without a peptizer, peptizer can be added after grain formation has been initiated.

While the current state of the art prefers the presence in the reaction vessel of at least 10 percent of the total peptizer used for the precipitation before the occurrence of grain formation, the initial peptizer concentration within the scope of this invention generally does not exceed about 8 percent of the total peptizer.

The silver ions are preferably supplied in an aqueous solution of silver nitrate. The bromide and iodide ions are preferably supplied, separately or together, in aqueous solutions of ammonium or alkali metal salts. Mignot U.S. Pat. No. 4,334,012, which is concerned with ultrafiltration during emulsion precipitation and here incorporated by reference, sets forth a variety of preferred procedures for managing the introduction of gelatino-peptizer, silver, bromide, and iodide ions during emulsion precipitations. Introduction of silver and halide ions in the forms of a Lippmann emulsion, as taught by Mignot, is specifically contemplated.

During precipitation silver, bromide, and optionally iodide salts are added to the reaction vessel by techniques well known in the precipitation of silver bromoiodide grains. Typically an aqueous silver salt solution of a soluble silver salt, such as silver nitrate, is introduced into the reaction vessel concurrently with the introduction of the bromide and iodide salts. The bromide and iodide salts are also typically introduced as aqueous salt solutions, such as aqueous solutions of one or more soluble ammonium, alkali metal (e.g., sodium or potassium), or alkaline earth metal (e.g., magnesium or calcium halide), or alkaline salts. The silver salt is at least initially introduced into the reaction vessel separately from the iodide salt. The iodide and bromide salts can be added to the reaction vessel separately or as a mixture.

With the introduction of silver salt into the reaction vessel the nucleation stage of grain formation is initiated. A population of grain nuclei are formed which are capable of serving as precipitation sites for silver bromide and silver iodide as the introduction of silver, bromide, and iodide salts continues. The precipitation of silver bromide and silver iodide onto existing grain nuclei constitutes the growth stages of grain formulation.

As an alternative to the introduction of silver, bromide, and iodide salts as aqueous solutions, it is specifically contemplated to introduce the silver, bromide, and iodide salts, initially or in the growth stage, in the form of fine silver halide grains suspended in dispersing medium. The grains are sized so that they are readily Ostwald ripened onto larger grain nuclei, if any are present, once introduced into the reaction vessel. The maximum useful fine grain sizes depend on the specific conditions within the reaction vessel, such as temperature and the presence of solubilizing and ripening agents. Fine silver bromide, silver iodide, and/or silver bromoiodide grains can be introduced. (Since bromide and/or iodide are precipitated in preference to chloride, it is also possible to employ silver chlorobromide and silver chlorobromoiodide fine grains.) The silver halide grains are preferably very fine—e.g., less than 0.1 μm in mean diameter, but can range up to 0.2 μm or greater in mean diameter, depending upon ripening conditions within the reaction vessel.

Subject to the pBr requirements set forth above, the concentrations and rates of silver, bromide, and iodide salt introductions can take any convenient conventional form. The silver and halide salts are preferably introduced in concentrations of from 0.1 to 5 moles per liter, although broader conventional concentration ranges, such as from 0.01 mole per liter to saturation, for example, are contemplated. Specifically preferred precipitation techniques are those which achieve shortened precipitation times by increasing the rate of silver and halide salt introduction during the run. The rate of silver and halide salt introduction can be increased either by increasing the rate at which the dispersing medium and the silver and halide salts are introduced or by increasing the concentrations of the silver and halide salts within the dispersing medium being introduced. It is specifically preferred to increase the rate of silver and halide salt introduction, but to maintain the rate of introduction below the threshold level at which the formation of new grain nuclei is favored—i.e., to avoid renucleation, as taught by Irie U.S. Pat. No. 3,650,757, Kurz U.S. Pat. No. 3,672,900, Saito U.S. Pat. No. 4,242,445, Wilgus German OLS No. 2,107,118, Teitscheid et al European patent application No. 80102242, and Wey "Growth Mechanism of AgBr Crystals in Gelatin Solution", *Photographic Science and Engineering,* Vol. 21, No. 1, Jan./Feb. 1977, p. 14, et. seq. By avoiding the formation of additional grain nuclei after passing into the growth stage of precipitation, relatively monodispersed tabular silver bromoiodide grain populations can be obtained. Emulsions having coefficients of variation of less than about 30 percent can be prepared employing the process of the present invention. (As employed herein the coefficient of variation is defined as 100 times the standard deviation of the grain diameter divided by the average grain diameter.) By intentionally favoring renucleation during the growth stage of precipitation, it is, of course, possible to produce polydispersed emulsions of substantially higher coefficients of variation.

The concentration of iodide in the silver bromoiodide emulsions of this invention can be controlled by the introduction of iodide salts. Any conventional iodide concentration can be employed. Even very small amounts of iodide—e.g., as low as 0.05 mole percent—are recognized in the art to be beneficial. In their preferred form the emulsions of the present invention incorporate at least about 0.1 mole percent iodide. Silver iodide can be incorporated into the tabular silver bromoiodide grains up to its solubility limit in silver bromide at the temperature of grain formation. Thus, silver iodide concentrations of up to about 40 mole percent in the tabular silver bromoiodide grains can be achieved at precipitation temperatures of 90° C. In practice precipitation temperatures can range down to near ambient room temperatures—e.g., about 30° C. It is generally preferred that precipitation be undertaken at temperatures in the range of from 40° to 80° C. For most photographic applications it is preferred to limit maximum iodide concentrations to about 20 (optimally 15) mole percent, based on silver.

The thin tabular grain emulsions can be put in photographic use as precipitated, but are in most instances adapted to serve specific photographic applications by procedures well known in the art. Once an emulsion has been prepared as described above any conventional vehicle can be introduced while still realizing all of the advantages of the invention described above. Conventional vehicle materials are illustrated by *Research Disclosure,* Item 17643, Section IX, cited above. The emulsions also can be blended with other silver halide emulsions, as illustrated by *Research Disclosure,* Item 17643, cited above, Section I, Paragraph F, and Dickerson U.S. Pat. No. 4,520,098, cited above. Conventional hardeners can be used, as illustrated by Item 17643, Section X. The emulsions can be washed following precipitation, as illustrated by Item 17643, Section II. The emulsions can be chemically and spectrally sensitized as described by Item 17643, Sections III and IV; however, the emulsions are preferably chemically and spectrally sensitized as taught by Kofron et al U.S. Pat. No. 4,439,520, cited above. The emulsions can contain antifoggants and stabilizers, as illustrated by Item 17643, Section VI.

SELECTED NUCLEATION CONDITIONS

From a variety of experimental investigations, in part reported in the Examples below, a narrow range of nucleation conditions have been selected that are capable of producing optimal or near optimal thin, tabular grain silver bromide and bromoiodide emulsions. The significant features of this nucleation approach are as follows:

The pBr within the reaction vessel during nucleation is maintained in the range of from 3 to 5 by adding an aqueous halide salt solution concurrently with addition of the aqueous silver salt solution. The iodide content of halide salt solution is maintained in the range of from 0 to 12 mole percent, based on total halide. The rate of silver addition during nucleation is in the range of from $1.00\times10^{-2}$ to 1.00 mole Ag/minute/liter of dispersing medium initially in the reaction vessel. No peptizer need be present in the reaction vessel during nucleation. When a peptizer is present in the reaction vessel, it is preferably a gelatino-peptizer as described above present in a concentration of up to 5 grams per liter. When a gelatino-peptizer is present, the pH within the reaction vessel is preferably maintained in the range of from 1.6 to 7.0, and the methionine content of the gelatino-peptizer is preferably maintained at a concentration of less than 30 (optimally less than 15) micromoles per gram of peptizer.

Except as indicated, nucleation procedures follow conventional practices or those set forth above.

TRANSITION TO THE GROWTH STAGE

While rates of addition to the reaction vessel can be varied within the ranges indicated above during the nucleation stage and then be progressively adjusted (ramped) to satisfy growth conditions, a practically convenient approach is introduce reactants during the nucleation stage at fixed rates until from about 0.02 to 10 mole percent of the total silver ion has been introduced into the reaction vessel. Thereafter reactant introductions are stopped (or brought to comparatively low levels). This interval allows adjustments to be undertaken as required to permit precipitation to be recommenced under conditions optimum for the growth stage of precipitation. This interval can be quite short when computer controlled equipment is employed. However, extended hold periods, ranging from minutes to days, are not detrimental, provided the grain nuclei are preserved in their initial form. This can be achieved by any of variety of known techniques, such as chilling the emulsion, withholding ripening agents from the reaction vessel during nucleation, etc.

SELECTED GROWTH CONDITIONS

When the selected nucleation conditions identified above are employed, thin, tabular grain emulsions satisfying the requirements of this invention can be realized by employing conventional growth stage conditions or any of the growth stage conditions described above as features of this invention.

The following illustrates a preferred growth condition capable of producing a thin, tabular grain emulsion even though the nucleation conditions, through within the contemplation of this invention, are not preferred. For example, if the rate of silver ion addition during the Selected Nucleation Conditions is reduced below $1\times10^{-2}$ mole Ag per minute per liter of dispersing medium initially in the reaction vessel, adjustments to fall within the following ranges can nevertheless result in producing thin, tabular grain emulsions as described above satisfying the requirements of this invention: Either no peptizer should be present in the reaction vessel during the nucleation stage or the peptizer should be held to less than 0.5 percent by weight, based on total weight of the reaction vessel contents. Iodide in the aqueous halide salt solution added concurrently with the aqueous silver salt solution during nucleation is maintained in the range from from 0.1 to 6.0 mole percent, based on total halide. The pH of the contents of the reaction vessel is maintained in the range of from 1.6 to 3.0. The pBr during the growth stage is maintained in the range of from 0.6 to 2.0, preferably 0.6 to 1.6. The molar rate of silver halide addition at the start of the growth stage is kept low relative to the addition rate used for nucleation—i.e., the ratio of addition rates for nucleation and the start of the growth stage is kept high, typically in the range of from 1 to 100. Finally, it is preferred that the gelatino-peptizer be present for growth, and it further preferred that such gelatino-peptizer have a low methionine content, preferably less than 30 micromoles of gram.

The foregoing conditions, of course, produce even higher proportions of thin, tabular grains when employed singly or together in combination with the preferred silver ion introduction rates described above. Thus, the combination of the parameters of the preceding paragraph and the preferred nucleation rates constitute an overall optimum procedure for thin, tabular grain silver bromoiodide emulsion preparation.

The emulsions of this invention can be used in otherwise conventional photographic elements to serve varied applications, including black-and-white and color photography, either as camera or print materials; image transfer photography; photothermography; and radiography. The remaining sections of *Research Disclosure,* Item 17643, illustrate features particularly adapting the photographic elements to such varied applications.

EXAMPLES

The invention can be better appreciated by reference to the following specific examples:

EXAMPLE 1 (CONTROL)

The purpose of this example is to demonstrate that procedures specifically described by Wilgus et al U.S. Pat. No. 4,414,310 will not produce thin, tabular grain emulsions when the sole nucleation modification is to increase the pBr to a level of 2.3.

Nucleation and early growth conditions were essentially those as described for Emulsion 2 in col. 48 of the '310 patent, except for the excess bromide ion concentration during the nucleation stage. The pBr value of 2.3 used in this example exceeded by 1.5 units the value actually used in the precipitation of the Emulsion 2 referred to above. The gelatin employed contained greater than 30 micromoles of methionine per grain, hereinafter referred to as nonoxidized gelatin.

A reaction vessel equipped with a stirrer was charged with 5.5 L of water containing 82.5 g of nonoxidized, nondeionized, lime-processed bone gelatin. At 80° prior to the start of precipitation, the pBr and pH values were adjusted to 2.3 (pAg 7.7) and 5.90, respectively, by addition of 1.0M NaBr and 1.0M $H_2SO_4$. Nucleation was accomplished by adding simultaneously, over a period of 2 minutes, 30 $cm^3$ of each of the following two solutions: 2.0M $AgNO_3$ and 2.1M NaBr. During nucleation, pAg was maintained at 7.7. After the cited double jet addition for nucleation, the silver addition was stopped and addition of the 2.1M NaBr solution was continued for approximately 11 minutes until a pBr value of 1.2 was attained (pAg 8.8), in order to achieve the same growth environment as employed in the cited Wilgus et al example. Once this pBr value was reached, a sample was taken for direct transmission electron micrographs, and then growth was effected by addition of 2.0M $AgNO_3$ at an accelerated rate (1.48×increase from start to finish) such that 470 $cm^3$ was added in 3.8 minutes, during which time 2.1M NaBr, was added at a rate sufficient to maintain a pAg value of 8.8. A total of 1.0 mole of AgBr was thus precipitated under the same conditions as employed in the Wilgus et al example for nucleation and early growth up to the point where this amount of AgBr had formed. The emulsion was then cooled to 35° C., a sample was taken for scanning electron microscopic (SEM) examination, and then a coagulation washing procedure was carried out.

Direct transmission electron micrographs of the sample taken after nucleation and adjustment of the pAg to 8.8 revealed no evidence of doubly twinned crystals. Scanning electron micrographs of the sample taken at the end of precipitation revealed a minor population of tabular grains; by number they represented approximately 3 percent, and accounted for only 24 percent of the projected area of the emulsion. Consequently this AgBr precipitate did not meet the definition of a tabular grain emulsion. The equivalent circular diameter (ECD) of the tabular grain population was 0.63 μm; mean thickness was 0.041 μm (obtained by measurement of SEM images of crystal edges). The remaining nontabular grains were predominantly of octahedral morphology.

EXAMPLE 2

This example demonstrates that thin tabular grain emulsion resulted from modified nucleation conditions even when they were coupled with growth conditions like those used for Example 1. Specifically, this example demonstrates that a propensity for thin, tabular grain formation was increased as a consequence of the following changes in nucleation variables: lower gelatin level, decreased pH, increased reactant concentration, and increased reactant addition rate.

A reaction vessel equipped with a stirrer was charged with 5.5 L of water containing 2.0 g of nonoxidized, nondeionized, lime-processed bone gelatin. At 80° C. prior to the start of precipitation, the pBr and pH values were adjusted to 2.3 (pAg 7.73) and 1.80, respectively, by addition of 1.0M NaBr and 1.0M $H_2SO_4$. Nucleation was accomplished by adding simultaneously, over a period of 0.15 minutes, 15 $cm^3$ of each of the following two solutions: 4.0M $AgNO_3$ and 4.2M NaBr. During this nucleation time, pAg was maintained at 7.73. After these solutions had been added, a sample of the emulsion was taken for examination by direct transmission electron microscopy. Next, a 2.1M NaBr solution was added for approximately 11 minutes until a pBr value of 1.2 was attained (pAg 8.8). Once this pBr value was reached, 80.5 g of the same gelatin used for nucleation, dissolved in 500 $cm^3$ $H_2O$ at 80° C. was added, the pH was adjusted to 5.9, and then growth was effected by addition of 2.0M $AgNO_3$ at an accelerated rate (1.48×from start to finish) such that 470 $cm^3$ was added in 3.8 minutes, during which time 2.1M NaBr was added at a rate sufficient to maintain a pAg value of 8.8. A total of 1.0 mole of AgBr was thus precipitated. The emulsion was then cooled to 35° C., a sample was taken for SEM examination, and then a coagulation washing procedure was carried out.

Examination of the direct electron micrograph of the sample taken immediately after nucleation showed that the crystals were small, but that approximately 20 number percent of them could be classified as being of the doubly parallel twinned type. This provided evidence that twinning had indeed occurred during nucleation. This interpretation was confirmed by data obtained from SEMs of the sample taken at the end precipitation, which indicated 25 number percent doubly parallel twinned crystals. Remaining crystals were of small diameter and were a mixture of octahedral and singly twinned types. Tabular grains provided approximately 88 percent of the projected area, so that this emulsion was clearly tabular. The ECD of the tabular grain population was 0.67 μm and the mean thickness was 0.66 μm so that the mean aspect ratio of this population was approximately 10. Since the growth portion of this precipitation was identical to that of Example 1, it is concluded that the greater proportion of tabular crystals resulted from changes in nucleation, which included decreased gelatin concentration and pH, and increased reactant concentration and addition rate.

EXAMPLE 3

This example demonstrates the effect that relative rates of reactant addition during nucleation and growth have on twinning. In particular, compared to that observed in Example 2, it shows that decreased reactant addition rates during growth caused the number percent tabular crystals in the final emulsion to increase significantly. This increased number of tabular crystals is probably caused by Ostwald ripening during growth, which results in the dissolution of smaller crystals, such as untwinned octahedra, and the deposition of AgBr contained in them onto tabular grains. Regardless of mechanism, the net result is an increased number percent of tabular grains in the final emulsion, so that a lower concentration of excess $Br^-$ is required during nucleation. The procedure for this precipitation was the same as for Example 2, except that the reactant addition rate during growth was 0.25 as great. (It is well-known in the art that flow rates for growth may be accelerated within limits while still avoiding renucleation. Thus, in a long precipitation, growth flow rates may greatly exceed those used in nucleation; a high nucleation to initial growth flow rate ratio is the factor whose effect is illustrated in this example.)

A reaction vessel equipped with a stirrer was charged with 5.5 L of water containing 2.0 g of nonoxidized, nondeionized, lime-processed bone gelatin. At 80° prior to the start of precipitation, the pBr and pH values were adjusted to 2.3 (pAg 7.73) and 1.80, respectively, by addition of 1.0M NaBr and 1.0M $H_2SO_4$. Nucleation was accomplished by adding simultaneously, over a period of 0.15 minutes, 15 $cm^3$ of each of the following two solutions: 4.0M $AgNO_3$ and 4.2M NaBr. During nucleation, pAg was maintained at 7.73. After the cited double jet nucleation, a 2.1M NaBr solution was added for approximately 11 minutes until a pBr value of 1.2 was attained (pAg 8.8). Once this pBr value was reached, 80.5 g of the same gelatin used for nucleation, dissolved in 500 $cm^3$ $H_2O$ at 80° C., was added, the pH was adjusted to 5.9, and then growth was effected by addition of 2.0M $AgNO_3$ at an accelerated rate (1.48× from start to finish) such that 470 $cm^3$ was added in 15.1 minutes, during which time 2.1M NaBr was added at a rate sufficient to maintain a pAg value of 8.8. A total of 1.0 mole of AgBr was thus precipitated. The emulsion was cooled to 35° C., a sample was taken for SEM examination, and then a coagulation washing procedure was carried out.

Examination of the SEM of the sample taken at the end of the precipitation demonstrated that 66 number percent of the crystals were of the doubly parallel twinned type. The remaining 34 number percent consisted a mixture of singly twinned and multiply nonparallel twinned crystals, and relatively few octahedra. The tabular grain population had an ECD of 1.44 μm, a mean thickness of 0.054 μm, and a mean aspect ratio of approximately 26. Approximately 94 per cent of the projected area of this emulsion was provided by tabular grains. Since relative to results of Example 2, there was a significant increase in both the number percent doubly parallel twinned crystals and in the fraction of projected area provided by tabular crystals, it is concluded that a high ratio of nucleation to growth flow rates enhances the relative proportion of tabular grains so that nucleation can be carried out more effectively at high pBr.

EXAMPLE 4

This example is a variant of Example 3 and the precipitation procedure was the same except for 1) use of (nonoxidized, nondeionized) phthalated gelatin rather than nonphthalated gelatin, and 2) pH was maintained at approximately 6 for both nucleation and growth, thereby obviating the need for low pH during nucleation as well as the upward adjustment prior to growth.

A reaction vessel equipped with a stirrer was charged with 5.5 L of water containing 2.0 g of (nonoxidized, nondeionized) phthalated (10% phthalic anhydride) lime-processed bone gelatin. At 80° prior to the start of precipitation, the pBr and pH were adjusted to 2.3 (pAg 7.7) and approximately 6, respectively. Nucleation was accomplished by adding simultaneously, over a period of 0.15 minutes, 15 $cm^3$ of each of the following two solutions: 4.0M $AgNO_3$ and 4.2M NaBr. During nucleation, pAg was maintained at 7.7. After the cited double jet nucleation, a 2.1M NaBr solution was added for approximately 11 minutes until a pBr value of 1.2 was attained (pAg 8.8). Once this pBr value was reached, 80.5 g of the same gelatin used for nucleation, dissolved in 500 $cm^3$ $H_2O$ at 80° C., was added, and then growth was effected by addition of 2.0M $AgNO_3$ at an accelerated rate (1.48× from start to finish) such that 470 $cm^3$ was added in 15.1 minutes, during which time 2.1M NaBr was added at a rate sufficient to maintain a pAg value of 8.8. A total of 1.0 mole of AgBr was thus precipitated. The emulsion was cooled to 35° C., a sample was taken for SEM examination, and then a coagulation washing procedure was carried out.

Results of this precipitation are to be compared to those of Example 3. Examination of the SEM of the sample taken at the end of the precipitation demonstrated that 73 number percent of the crystals were of the double parallel twinned type. The remaining 27 number percent consisted of a mixture of singly twinned, and multiply nonparallel twinned crystals, and relatively few octahedra. The tabular grain population had an ECD of 0.99 μm, a mean thickness of 0.064 μm, and a mean aspect ratio of approximately 15. This population accounted for 88% of the projected area of the emulsion. Since this emulsion contained a high number percent tabular grains, it is concluded that tabular grain nucleation at high pBr can be carried out in phthalated nonoxidized gelatin and that low pH nucleations are not essential.

EXAMPLE 5

This example demonstrates that tabular grain nucleation can be carried out at pBr 3.3. In addition to the change in nucleation pBr, it also differs from foregoing examples in the temperature of precipitation (60° C. rather than 80° C.), in the composition of the nucleation precipitate ($AgBr_{.88}I_{.12}$ rather than AgBr), in the use of pBr 1.41 rather than 1.2 for growth, and in the total amount of Ag(Br,I) precipitated (1.5 rather than 1.0 moles). (Note that subsequent examples involved precipitation of 0.5 moles of Ag(Br,I), and SEM examination of a sample taken during this precipitation when 0.5 mole had been precipitated allows comparison to them. It is believed that precipitations involving smaller amounts of AgX in growth provide a more critical test of tabular grain nucleation at high pBr.

A reaction vessel equipped with a stirrer was charged with 4.5 L of water containing 2.25 g of lime-processed bone gelatin (neither deionized nor oxidized). At 60° C. the pBr was adjusted to 3.30 (pAg 7.48) with NaBr and the pH was adjusted to 1.81 with sulfuric acid. Nucleation was accomplished by adding simultaneously, over a period of 0.25 minutes, 30 $cm^3$ of a 0.5M $AgNO_3$ solution and 30 $cm^3$ of a solution that was 0.44M in NaBr and 0.06M in NaI. Since this was a balanced molar addition of $AgNO_3$ and halide salts, pAg remained approximately constant during nucleation. After these nucleation reactants were added, the resulting mixture was stirred continuously at 60° C. for 17 minutes, at which time a sample was taken for electron microscopic examination, then 25 g of the same gelatin used for nucleation, dissolved in 200 $cm^3$ of water at 60° C., was added, and then the pH was adjusted to 6.0 with NaOH. At 19.5 minutes after nucleation, the pBr of the mixture was adjusted to 1.43 with NaBr (pAg 9.28) and starting at 20 minutes after nucleation and continuing for 38.4 additional minutes, a 1M solution of $AgNO_3$ was added at a linearly accelerated rate (6.76× from start to finish). A 1.1M solution of NaBr was added concurrently as required to maintain the pAg at 9.28. A total of 1.5 moles of AgBr were formed in this precipitation. The emulsion was then cooled to 40° C., a solution of phthalated gelatin (50 g in 500 $cm^3$ distilled water) was added, and coagulation washed two times. Samples were withdrawn for examination by SEM when 0.5 moles of silver halide had been precipitated, and at the end of precipitation before washing.

Analysis of a transmission electron micrograph of the sample taken 17 min after nucleation (before pBr was decreased prior to growth) revealed that approximately 19 number-% of the crystals were of a morphology normally associated with Ag(Br,I) crystals which contain two parallel twin planes and which become tabular as a result of rapid two dimensional growth. These data demonstrate that tabular grain nucleation did occur at pBr 3.3. A SEM of the sample taken after 0.5 mole of AgBr had been precipitated showed that more than 82 number-% of the crystals were of the doubly parallel twinned type, and approximately 88% of the projected area was represented by tabular grains. The ECD of the mean projected crystal area of the tabular grain population was 0.39 μm and the mean thickness was estimated to be 0.028 μm, so that their mean aspect ratio was approximately 13. SEM analysis of the sample taken at the end of precipitation demonstrated that 84 number percent of the grains were of the doubly parallel twinned type tabular grain population had an ECD of 0.71 μm and a mean thickness of 0.045 μm, so that the corresponding mean aspect ratio was approximately 15, and it represented more than 92% of the projected area of the emulsion.

EXAMPLE 6

This precipitation is similar to Example 5 except for 1) oxidized, deionized, lime-processed bone gelatin was used, 2) the growth pBr was 1.74 rather than 1.43, and 3) only 0.5 moles of silver halide were precipitated.

A reaction vessel equipped with a stirrer was charged with 4.5 L of water containing 2.25 g of oxidized, deionized, lime-processed bone gelatin. At 60° C. the pBr was adjusted to 3.30 (pAg 7.44) with NaBr and the pH was adjusted to 1.83 with sulfuric acid. Nucleation was accomplished by adding simultaneously, over a period of 0.25 minutes, 30 $cm^3$ of a 0.5 M $AgNO_3$ solution and 30 $cm^3$ of a solution that was 0.44M in NaBr and 0.06M in NaI. Since this was a balanced molar addition of $AgNO_3$ and halide salts, pAg remained approximately constant at 7.44 during nucleation. After these reactants were added, the resulting mixture was stirred continuously at 60° C. for 17 minutes, at which time a sample was taken for examination by transmission electron microscopy, then 25 g of the cited gelatin, dissolved in 200 $cm^3$ of water at 60° C., was added, and then the pH was adjusted to 6.0 with NaOH. At 19.5 minutes after nucleation, the pBr of the mixture was adjusted to 1.74 with NaBr (pAg 8.96) and starting at 20 minutes after nucleation and continuing for 20 additional minutes, a 1 M solution of $AgNO_3$ was added at a linearly accelerated rate (4.0× from start to finish). A 1.0M solution of NaBr was added concurrently as required to maintain the pAg at 8.96. A total of 0.5 mole of AgBr was formed in this precipitation. The emulsion was sampled for examination by scanning electron microscopy, then it was cooled to 40° C. Next, 50 g of phthalated gelatin dissolved in 500 $cm^3$ water was added, and finally a coagulation washing procedure was carried out.

Direct electron micrographs of the sample that was withdrawn 17 minutes after nucleation revealed a range of crystal shapes that was similar to that seen in the corresponding sample from the emulsion described in Example 5. On the basis of these micrographs, it was determined that approximately 14 number-% of the grains were of the doubly parallel twinned type which would be expected to develop into tabular crystal during the growth phase of this precipitation. The sample taken at the end of precipitation contained 75 number-% doubly parallel twinned crystals and approximately 83 percent of the projected area was provided by tabular grains. ECD and mean thickness values for the tabular crystals were approximately 0.46 and 0.027 μm, respectively, so that the mean aspect ratio for this population was approximately 16.

EXAMPLE 7

Precipitation of this emulsion followed a procedure identical to that used in Example 6 except for the fact that no NaBr was added to the reaction vessel prior to addition of $AgNO_3$ and halide salt solutions during nucleation.

A reaction vessel equipped with a stirrer was charged with 4.5 L of water containing 2.25 g of oxidized, deionized, lime-processed bone gelatin. At 60° C. prior to the start of nucleation, the pH was adjusted to 1.83 with sulfuric acid. No deliberate addition of halide salt was made to the reaction vessel prior to nucleation. The silver ion potential was established by silver complexing moieties in the gelatin solution, which led to a pAg of 5.92. During nucleation the pAg remained at approximately this value, which corresponds to pBr 4.80, by virtue of balanced molar addition of $AgNO_3$ and halide salts. Nucleation was accomplished by adding simultaneously, over a period of 0.25 minutes, 30 $cm^3$ of a 0.5 M $AgNO_3$ solution and 30 $cm^3$ of a solution that was 0.44M in NaBr and 0.06M in NaI. After these reactants were added, the resulting mixture was stirred continuously at 60° C. for 17 minutes, at which time a sample was taken for electron microscopic examination, then 25 g of the same gelatin as used for nucleation, dissolved in 200 $cm^3$ of water at 60° C., was added, and then the pH was adjusted to 6.0 with NaOH. At 19.5 minutes after nucleation, the pBr of the mixture was adjusted to 1.74 with NaBr (pAg 8.96) and starting at 20 minutes after nucleation and continuing for 20 additional minutes, a 1M solution of $AgNO_3$ was added at a linearly accelerated rate (4.0× from start to finish). A 1.0M solution of NaBr was added concurrently as required to maintain the pAg at 8.96. A total of 0.5 mole of AgBr was formed in this precipitation. The emulsion was sampled for examination by scanning electron microscopy, then it was cooled to 40° C. Next, 50 g of phthalated gelatin dissolved in 500 $cm^3$ water was added, and finally a coagulation washing procedure was carried out.

Direct transmission electron micrographs of the sample that was withdrawn 17 minutes after nucleation revealed a range of grain sizes that was smaller than observed in Examples 5 or 6. As a consequence, it was more difficult to distinguish doubly parallel twinned crystals from three dimensional ones in this sample then in corresponding ones from the two prior examples. Nonetheless, on the basis of shape and relative density to the transmission of electrons, it was still inferred that a significant fraction of the grains contained two parallel twin planes. This was consistent with the observation that the sample taken at the end of precipitation contained 79 number-% doubly parallel twinned crystals and 92 percent of the projected area was provided by tabular grains. The tabular grain population had an ECD of 0.48 μm and a mean thickness of 0.028 so that the mean aspect ratio of the tabular grain population was approximately 17.

Examples 8, 9, 10, and 11 demonstrate the importance of nucleation conditions, and to a lesser extent the role of the growth environment in obtaining a tabular grain emulsion. These precipitations are modifications of Example 7, in which variations are made in some of the nucleation factors in order to show that they are indeed the cause of tabular grain nucleation at high pBr.

EXAMPLE 8

This precipitation was identical to Example 7, except 1) the entire 27.25 g of precipitation gelatin was present in the reaction vessel, during both nucleation and growth rather than having only 2.25 g present during nucleation and then adding an additional 25 g before the start of growth, 2) the pH was adjusted to 6.0 prior to nucleation, rather than having it at 1.83 for nucleation and 6.0 for growth, and 3) the halide run salt solution for nucleation was 0.50M NaBr, rather than a solution that was 0.44M in NaBr and 0.06M in NaI.

A reaction vessel equipped with a stirrer was charged with 4.5 L of water containing 27.25 g of oxidized, deionized, lime-processed bone gelatin. At 60° C. prior to the start of nucleation, the pH was adjusted to 6.00 with sodium hydroxide. No deliberate addition of halide salt was made to the reaction vessel prior to nucleation. The silver ion potential was established by silver complexing moieties in the gelatin solution, which led to a pAg of 6.03. During nucleation, the pAg remained at approximately this value, which corresponds to pBr 4.78, by virtue of balanced molar addition rates for silver and halide salts. Nucleation was accomplished by adding simultaneously, over a period of 0.25 minutes, 30 $cm^3$ of a 0.5M $AgNO_3$ solution and 30 $cm^3$ of a 0.50M NaBr solution. After these reactants were added, the resulting mixture was stirred continuously at 60° C. for 19.5 minutes, at which time the pBr of the mixture was adjusted to 1.74 with NaBr (pAg 8.96). The growth phase of the precipitation was started 20 minutes after nucleation and continuation for 20 additional minutes, during which time a 1M solution of $AgNO_3$ was added at a linearly accelerated rate (4.0× from start to finish). A 1.0M solution of NaBr was added concurrently as required to maintain the pAg at 8.96. A total of 0.5 mole of AgBr was formed in this precipitation. The emulsion was sampled for SEM examination, then it was cooled to 40° C. Next, 50 g of phthalated gelatin dissolved in 500 $cm^3$ water was added, and finally a coagulation washing procedure was carried out.

Examination of the scanning electron micrographs of the sample taken at the end of the precipitation revealed that 85% of the emulsion's projected area was provided by tabular grains. However, by number, only 18 percent of the grains were tabular. The remaining 82 percent of the crystals were predominantly of the singly twinned type with a minor population of octahedra. This clearly demonstrates that markedly less twinning occurred in the nucleation step of this emulsion than in Example 7, due to a higher level of gelatin, higher pH, and NaBr rather than 88% NaBr and 12% NaI nucleation reactant halide solution.

EXAMPLE 9

This emulsion was precipitated by a procedure that was closely related to the one used for Example 8, but the twinning propensity during nucleation was further reduced by having a still higher level of gelatin present in nucleation (54.5 g rather than 27.25 g, and as in Example 8, no additional gelatin was added prior to growth), and by reducing the addition rate of $AgNO_3$ and NaBr during nucleation (nucleation time was 2.5 rather than 0.25 minutes.)

A reaction vessel equipped with a stirrer was charged with 4.5 L of water containing 54.5 g of oxidized, deionized, lime-processed bone gelatin. At 60° C. prior to the start of nucleation, the pH was adjusted to 6.00 with sodium hydroxide. No deliberate addition of halide salt was made to the reaction vessel prior to nucleation. The silver ion potential was established by silver complexing moieties in the gelatin solution, which led to a pAg of 6.09. During nucleation the pAg remained at approximately this value, which corresponds to pBr 4.72, by virtue of balanced molar addition rates of silver and halide salts. Nucleation was accomplished by adding simultaneously, over a period of 2.5 minutes, 30 $cm^3$ of a 0.5M $AgNO_3$ solution and 30 $cm^3$ of a 0.50 M NaBr solution. After these reactants were added, the resulting mixture was stirred continuously at 60° C. for 19.5 minutes, at which time the pBr of the mixture was adjusted to 1.74 with NaBr (pAg 8.96). The growth phase of the precipitation was started 20 minutes after nucleation and continued for 20 additional minutes, during which time a 1M solution of $AgNO_3$ was added at a linearly accelerated rate (4.0× from start to finish). A 1.0M solution of NaBr was added concurrently as required to maintain the pAg at 8.96. A total of 0.5 mole of AgBr was formed in this precipitation. The emulsion was sampled for examination by scanning electron microscopy, then it was cooled to 40° C. Next, 50 g of phthalated gelatin dissolved in 500 $cm^3$ water was added, and finally a coagulation washing procedure was carried out.

Scanning electron micrographs of the sample taken at the end of the precipitation showed no evidence of tabular crystals. On the contrary, the emulsion consisted almost entirely of octahedral crystals with an ECD of 0.18 μm (standard deviation of the population in linear terms was approximately 11% of the ECD), and approximately 2% by number of similarly sized singly-twinned crystals.

EXAMPLE 10

This emulsion was prepared exactly as was Example 9, except that nonoxidized, nondeionized, lime-processed bone gelatin was used. Results were substantially the same as in Example 9, with the ECD of resulting octahedral crystals being 0.20 μm.

EXAMPLE 11

This precipitation employed the nucleation conditions of Example 7 and the growth conditions of Example 9. Thus this precipitation was identical to Example 7 except that it used 54.5 g rather than 27.25 g of gelatin for growth.

A reaction vessel equipped with a stirrer was charged with 4.5 L of water containing 2.25 g of oxidized, deionized, lime-processed bone gelatin. At 60° C. prior to the start of nucleation, the pH was adjusted to 1.83 with sulfuric acid. No deliberate addition of halide salt was made to the reaction vessel prior to nucleation. The silver ion potential was established by silver complexing moieties in the gelatin solution, which led to a pAg of 5.92. During nucleation the pAg remained at approximately this value, which corresponds to pBr 4.80, by virtue of balanced molar addition rates of silver and halide salts. Nucleation was accomplished by adding simultaneously, over a period of 0.25 minutes, 30 $cm^3$ of a 0.5M $AgNO_3$ solution and 30 $cm^3$ of a solution that was 0.44M in NaBr and 0.06M in NaI. After these reactants were added, the resulting mixture was stirred continuously at 60° C. for 17 minutes, at which time 52.25 g of the cited gelatin, dissolved in 500 $cm^3$ of water at 60° C., was added, and then the pH was adjusted to 6.0 with NaOH. At 19.5 minutes after nucleation, the pBr of the mixture was adjusted to 1.75 with NaBr (pAg 8.96) and starting at 20 minutes after nucleation and continuing for 20 additional minutes, a 1M solution of $AgNO_3$ was added at a linearly accelerated rate (4.0× from start to finish). A 1.0M solution of NaBr was added concurrently as required to maintain the pAg at 8.96. A total of 0.5 mole of AgBr was formed in this precipitation. The emulsion was sampled for examination by scanning electron microscopy, then it was cooled to 40° C. Next, 50 g of phthalated gelatin dissolved in 500 $cm^3$ water was added, and finally a coagulation washing procedure was carried out.

Scanning electron micrographs of the sample taken at the end of the precipitation revealed that approximately 44 number-% of the crystals were of the doubly parallel twinned type, with octahedra and singly-twinned grains being predominant in the remaining 56%. Tabular crystals accounted for approximately 90% of the projected area, and the ECD and mean thickness of this population was 0.35 and 0.03 μm , respectively, so that the corresponding mean aspect ratio was approximately 11. Since growth conditions for this precipitation were identical to those for Example 9 wherein no tabular crystals were produced, it is clearly evident that twinning occurred in the nucleation phase of this precipitation rather than in the lower pBr environment used for growth. However, when the results of this precipitation are compared to those of Example 7, it is evident that growth environment plays a role in achieving a high number-% tabular crystals. The higher gelatin level used for growth in the present example gave a somewhat reduced number-% doubly parallel twinned crystals, probably because it inhibited either the twinning of untwinned or singly twinned crystals that were formed in nucleation, or the ripening of such particles onto crystals that were twinned in nucleation.

EXAMPLE 12

This precipitation demonstrates that the pBr for nucleation can be extended to a value still higher than that used in Example 7. The procedure for this precipitation was identical to that of Example 7 except for the fact that $AgNO_3$ was added to the reaction vessel prior to the start of nucleation in order to raise its pBr to 5.75 (compared to pBr of 4.90 used for nucleation in Example 7.)

A reaction vessel equipped with a stirrer was charged with 4.5 L of water containing 2.25 g of oxidized, deionized, lime-processed bone gelatin. At 60° C. prior to the start of nucleation, the pH was adjusted to 1.83 with sulfuric acid. Next, the pAg was adjusted to 4.97 (pBr 5.75) by addition of a dilute solution of $AgNO_3$. During nucleation the pAg remained at approximately this value by virtue of a balanced addition of silver and halide salts. Nucleation was accomplished by adding simultaneously, over a period of 0.25 minutes, 30 $cm^3$ of a 0.5 M $AgNO_3$ solution and 30 $cm^3$ of a solution that was 0.44M in NaBr and 0.06M in NaI. After these reactants were added, the resulting mixture was stirred continuously at 60° C. for 17 minutes, at which time 25 g of the same gelatin as used for nucleation, dissolved in 200 $cm^3$ of water at 60° C., was added, and then the pH was adjusted to 6.0 with NaOH. At 19.5 minutes after nucleation, the pBr of the mixture was adjusted to 1.74 with NaBr (pAg 8.96) and starting at 20 minutes after nucleation and continuing for 20 additional minutes, a 1M solution of $AgNO_3$ was added at a linearly accelerated rate (4.0× from start to finish). A 1.0M solution of NaBr was added concurrently as required to maintain the pAg at 8.96. A total of 0.5 mole of AgBr was formed in this precipitation. The emulsion was sampled for examination by scanning electron microscopy, then it was cooled to 40° C. Next, 50 g of phthalated gelatin dissolved in 500 $cm^3$ water was added, and finally a coagulation washing procedure was carried out.

Scanning electron micrographs of the sample taken at the end of precipitation revealed that 47 number-% of the crystals were of the doubly parallel twinned type. Ninety-three percent of the projected area of the emulsion was provided by tabular crystals; the ECD and mean thickness of this population was 0.42 and 0.025 μm , respectively, so that its mean aspect ratio was approximately 16.

EXAMPLE 13

This example involves a single-jet $AgNO_3$ nucleation at a pX value of 3.30, where X is the total concentration of a mixture of $BR^-$ and $I^-$ ions in a ratio of 0.88 to 0.12, respectively. For this precipitation, both the excess halide concentration in the reaction vessel before initiation of nucleation and the growth conditions were similar to those of Example 6. Comparison of these results to those of Example 6 demonstrates that although the halide stream plays a role in nucleation of doubly parallel twinned crystals, tabular emulsions still can be produced in precipitations involving single-jet nucleations at high pBr. It also demonstrates that iodide ions can be present in the reaction vessel prior to nucleation of the tabular grains.

A reaction vessel equipped with a stirrer was charged with 4.5 L of water containing 2.25 g of oxidized, deionized, lime-processed bone gelatin. At 60° C. the pX was adjusted to 3.3 by adding 2.25 $cm^3$ of a solution that was 0.88M in NaBr and 0.12M in NaI. Prior to the start of nucleation, the pH was adjusted to 1.83 with sulfuric acid. Nucleation was accomplished by adding over a period of 0.033 minutes, 4.0 $cm^3$ of a 0.5M $AgNO_3$ solution. Since there was no compensating halide solution added during this time, the pBr was calculated to have increased to 4.26, assuming that the iodide was completely removed by precipitation with $Ag^+$; this value was in good agreement with that inferred from the pAg value measured at this time (6.68). After this quantity of $AgNO_3$ was added, the resulting mixture was stirred continuously at 60° C. for 17 minutes, then 25 g of the same gelatin as used for nucleation, dissolved in 200 $cm^3$ of water at 60° C., was added, and then the pH was adjusted to 6.0 with NaOH. At 19.5 minutes after nucleation, the pBr of the mixture was adjusted to 1.70 with NaBr (pAg 8.96) and starting at 20 minutes after nucleation and continuing for 20 additional minutes, a 1M solution of $AgNO_3$ was added at a linearly accelerated rate (4.0×from start to finish). A 1.0M solution of NaBr was added concurrently as required to maintain the pAg at 8.96. A total of 0.5 mole of AgBr was formed in this precipitation. The emulsion was sampled for examination by scanning electron microscopy, then it was cooled to 40° C. Next, 50 g of phthalated gelatin dissolved in 500 $cm^3$ water was added, and finally a coagulation washing procedure was carried out.

Scanning electron micrographs of the sample taken at the end of the precipitation revealed that approximately 15% of the crystals were of the doubly parallel twinned type. Approximately 90% of the projected area of the emulsion was provided by tabular crystals; they had ECD and thickness values of 0.822 and 0.03 μm, respectively, so that the mean aspect ratio of this population was approximately 27. Since the number percent of tabular crystals is considerably lower in this emulsion than in Example 6, it is evident that the methods of Example 6 result in a greater propensity for nucleation of doubly parallel twinned crystals. It is also clear from the present example, however, that double-jet nucleations are not essential for nucleation of tabular grain emulsions at high pBr values.

Example 14 followed the procedure described above for Example 7, except for the use of nonoxidized gelatin. Comparison to Example 7 demonstrate that twinning propensity was reduced through use of nonoxidized gelatin. Example 15 demonstrates that compensation could be made for the lowered twinning propensity which resulted from use of nonoxidized gelatin by employing lower gelatin concentration during nucleation.

EXAMPLE 14

A reaction vessel equipped with a stirrer was charged with 4.5 L of water containing 2.25 g of nonoxidized, nondeionized, lime-processed bone gelatin. At 60° C. prior to the start of nucleation, the pH was adjusted to 1.83 with sulfuric acid. No deliberate addition of halide salt was made to the reaction vessel prior to nucleation. The silver ion potential was established by silver complexing moieties in the gelatin solution, which led to a pAg of 6.11. During nucleation the pAg remained at approximately this value, which corresponds to pBr 4.60, by virtue of balanced molar addition of $AgNO_3$ and halide salts. Nucleation was accomplished by adding simultaneously, over a period of 0.25 minutes, 30 $cm^3$ of a 0.5M $AgNO_3$ solution and 30 $cm^3$ of a solution that was 0.44M in NaBr and 0.06M in NaI. After these reactants were added, the resulting mixture was stirred continuously at 60° C. for 17 minutes, at which time 25 g of the same gelatin as used for nucleation, dissolved in 200 $cm^3$ of water at 60° C., was added, and then the pH was adjusted to 6.0 with NaOH. At 19.5 minutes after nucleation, the pBr of the mixture was adjusted to 1.74 with NaBr (pAg 8.99) and starting at 20 minutes after nucleation and continuing for 20 additional minutes, a 1M solution of $AgNO_3$ was added at a linearly accelerated rate (4.0×from start to finish). A 1.0M solution of NaBr was added concurrently as required to maintain the pAg at 8.99. A total of 0.5 mole of AgBr was formed in this precipitation. The emulsion was sampled for examination by scanning electron microscopy, then it was cooled to 40° C. Next, 50 g of phthalated gelatin dissolved in 500 $cm^3$ water was added, and finally a coagulation washing procedure was carried out.

Scanning electron micrographs of the sample taken at the end of the precipitation showed the emulsion to be composed of approximately 11 number-% doubly-twinned crystals, and approximately 57 percent of the projected area of the emulsion was provided by tabular crystals. Most of the remaining grains were of the octahedral or singly-twinned type. The tabular grain population had an ECD of 0.32 μm and a mean thickness of 0.04 μm, and a mean aspect ratio of approximately 8. Thus it is concluded that a direct substitution of nonoxidized gelatin into the procedure of Example 7 resulted in a significant diminution of the twinning propensity, but that the resulting emulsion met the tabular definition.

EXAMPLE 15

The procedure for precipitation of this emulsion was the same as that used for Example 14 except that the level of gelatin in nucleation was decreased in order to increase twinning propensity.

A reaction vessel equipped with a stirrer was charged with 4.5 L of water containing 1.00 g of nonoxidized, nondeionized, lime-processed bone gelatin. At 60° C. prior to the start of nucleation, the pH was adjusted to 1.83 with sulfuric acid. No deliberate addition of halide salt was made to the reaction vessel prior to nucleation. The silver ion potential was established by silver complexing moieties in the gelatin solution, which led to a pAg of 5.95. (This value is lower than the corresponding measurement in Example 14 because of the lower gelatin level used here.) During nucleation the pAg remained at approximately this value, which corresponds to pBr 4.74, by virtue of balanced molar addition of $AgNO_3$ and halide salts. Nucleation was accomplished by adding simultaneously, over a period of 0.25 minutes, 30 $cm^3$ of a 0.5M $AgNO_3$ solution and 30 $cm^3$ of a solution that was 0.44M in NaBr and 0.06M in NaI. After these reactants were added, the resulting mixture was stirred continuously at 60° C. for 17 minutes, at which time 26.25 g of the same gelatin as used for nucleation, dissolved in 200 $cm^3$ of water at 60° C., was added, and then the pH was adjusted to 6.0 with NaOH. At 19.5 minutes after nucleation, the pBr of the mixture was adjusted to 1.74 with NaBr (pAg 8.99) and starting at 20 minutes after nucleation and continuing for 20 additional minutes, a 1M solution of $AgNO_3$ was added at a linearly accelerated rate (4.0×from start to finish). A 1.0M solution of NaBr was added concurrently as required to maintain the pAg at 8.99. A total of 0.5 mole of AgBr was formed in this precipitation. The emulsion was sampled for examination by scanning electron microscopy, then it was cooled to 40° C. Next, 50 g of phthalated gelatin dissolved in 500 $cm^3$ water was added, and finally a coagulation washing procedure was carried out.

Scanning electron micrographs of the sample taken at the end of the precipitation showed that approximately 27 number-% of the grains were of the doubly parallel twinned type, and that approximately 71 percent of the projected area of the emulsion was provided by tabular crystals. The remainder of the crystals were predominantly of the octahedral and singly twinned type. The ECD of the tabular grain population was 0.37 μm and the mean thickness was 0.033 μm, so that the mean aspect ratio of this population was approximately 11.

EXAMPLE 16

This example used an 18 mole percent iodide nucleation, which is higher than in any of the foregoing examples, and AgBr (0.962)I(0.038) rather than AgBr is formed during growth. This example therefore further illustrates that iodide-rich tabular grain nuclei can be formed at high pBr, and that such nucleations can be followed by Ag(Br,I) growth to produce high aspect ratio tabular emulsions.

A reaction vessel equipped with a stirrer was charged with 3.0 L of water containing 7.5 g of oxidized, deionized, lime-producing bone gelatin. At 35° C. prior to the start of nucleation, the pH was adjusted to 1.80 with sulfuric acid, and the pBr was adjusted to 2.78 with KBr, which corresponds to a pAg value of 9.00. Nucleation was accomplished by adding simultaneously, over a period of 0.2 minutes, 16 $cm^3$ of a 1.25M $AgNO_3$ solution and 16 $cm^3$ of a solution that was 1.025M in KBr and 0.255M in KI (18 mole-% KI). During nucleation, the pAg remained at approximately unchanged by virtue of stoichiometrically balancing the silver and halide ion addition rates. After these reactants were added, the resulting mixture was stirred continuously while the temperature was raised linearly from 35° to 60° C. over a period of 15 minutes. The mixture was then held and stirred at 60° C. for 3 minutes. During the next 3 minutes and in the stated order with continuous stirring was added 100 g of the above oxidized gelatin dissolved in 500 cc of water at 55° C., NaOH solution to adjust the pH to 6.0, and KBr solution to adjust the pBr to 1.70 (pAg=8.93). Starting at 21 minutes after nucleation and continuing for 38.6 additional minutes, a 1.2M solution of $AgNO_3$ was added at a linearly accelerated rate of 1.23×from start to finish. A 1.2M solution of KBr was added concurrently as required to maintain the pAg at 8.93. Simultaneous with the addition of $AgNO_3$ and KBr solutions, a suspension of AgI was added at a molar addition rate that was 3.8% as great as the sum of the molar rates of $AgNO_3$ and AgI. (The AgI so added rapidly recrystallized and was completely incorporated into the growing Ag(Br,I) crystals.) A total of 1.53 moles of Ag(Br,I) was formed in this precipitation. The emulsion was sampled for examination by scanning electron microscopy, cooled to 40° C., and finally washed by a coagulation procedure.

SEM pictures taken at the end of the precipitation revealed that 82% of the crystal by number were tabular. This population of grains had an ECD of 0.78 μm and a mean thickness of 0.036 μm. This gives an average aspect ratio of approximately 21. The remaining 18% of crystals were predominantly multiply nonparallel-twinned 3-d grains. The fraction of the projected area provided by tabular grains was 88%.

The invention has been described in detail with particular reference to preferred embodiments thereof, but it will be understood that variations and modifications can be effected within the scope of the invention.

What is claimed is:

1. A process for the preparation within a reaction vessel of a thin tabular grain silver bromide or bromoiodide emulsion wherein tabular grains having a thickness of less than 0.2 μm exhibit an average aspect ratio of greater than 5:1 and account for at least 50 percent of total grain projected area of said emulsion, said process comprising introducing into said reaction vessel an aqueous dispersing medium and silver, bromide, and, optionally, iodide ions, and maintaining pBr values within said reaction vessel during grain nucleation and growth that favors the formation and growth of tabular grains, characterized in that at the time said tabular grains are being formed, (a) pH in said reaction vessel is maintained at a value ranging from 0.8 to 10.0 and (b) a gelatino-peptizer is present in the reaction vessel in a concentration of from 0 to 45 g per liter of said dispersing medium.

pBr values within said reaction vessel of at least 2.3 are maintained during grain nucleation, with the proviso that when gelatino-peptizer which has a methionine content of less than 30 micromoles per gram of gelatino-peptizer is present in said dispersing medium during grain nucleation, the pBr within said reaction vessel is maintained at a value greater than 2.4, and the molar ratio of reactant flow rates during grain nucleation to reactant flow rates at the start of grain growth ranges from 1.0 to 50.

2. A process according to claim 1 further characterized in that the pBr within the reaction vessel is maintained in a range of from 2.3 to 9.5 at the time that said tabular grains are being formed.

3. A process according to claim 2 further characterized in that the pBr within the reaction vessel is maintained in a range of from 2.3 to 8.0 at the time that said tabular grains are being formed.

4. A process according to claim 3 further characterized in that the pBr within the reaction vessel is maintained in a range of from 2.3 to 6.5 at the time that said tabular grains are being formed.

5. A process according to claim 1 further characterized in that at the time that said tabular grains are being formed a gelatino-peptizer is present in the reaction vessel in a concentration of from 0 to about 20 g per liter of said dispersing medium.

6. A process according to claim 5 further characterized in that at the time that said tabular grains are being formed a gelatino-peptizer is present in the reaction vessel in a concentration of from 0 to about 10 g per liter of said dispersing medium.

7. A process according to claim 1 further characterized in that at the time that said tabular grains are being formed the pH in the reaction vessel is maintained at a value ranging from about 1.2 to 8.5.

8. A process according to claim 7 further characterized in that at the time that said tabular grains are being formed the pH in the reaction vessel is maintained at a value ranging from about 1.6 to 7.0.

9. A process according to claim 1 further characterized in that the preparation is carried out in the presence of gelatin containing less than 30 micromoles of methionine per gram.

10. A process according to claim 9 further characterized in that the preparation is carried out in the presence of gelatin containing less than 15 micromoles of methionine per gram.

11. A process according to claim 1 further characterized in that the preparation is carried out in the presence of phthalated gelatin.

12. A process according to claim 1 further characterized in that at the time that said tabular grains are being formed the level of iodide ions is less than 42 mole percent, based on precipitated silver ions.

13. A process according to claim 1 further characterized in that at the time that said tabular grains are being formed the level of iodide ions is less than 24 mole percent, based on precipitated silver ions.

14. A process according to claim 1 further characterized in that silver ion is initially introduced into the reaction vessel at a first flow rate during an initial, nucleation stage, the rate of silver ion introduction is decreased during a transition interval, and silver ion introduction is increased abruptly to an introduction level above the transition interval.

15. A process according to claim 1 further characterized in that the molar ratio of reactant flow rates during grain nucleation to reactant flow rates at the start of grain growth ranges from about 1 to 50.

16. A process according to claim 15 further characterized in that the molar ratio of reactant flow rates during grain nucleation to reactant flow rates at the start of grain growth ranges from about 1.5 to 15.

17. A process according to claim 1 further characterized in that the pBr within the reaction vessel is maintained at a value ranging from 0.6 to 4.5 at the time that said tabular grains are being grown.

18. A process according to claim 17 further characterized in that the pBr within the reaction vessel is maintained at a value ranging from 0.85 to 3.3 at the time that said tabular grains are being grown.

19. A process according to claim 18 further characterized in that the pBr within the reaction vessel is maintained at a value ranging from 1.0 to 2.75 at the time that said tabular grains are being grown.

20. A process according to claim 1 further characterized in that the pBr during grain nucleation is maintained in the range of from 3 to 5, the rate of silver addition during nucleation is the range of from $1.00\times10^{-2}$ to 1.00 mole Ag/-minute/liter of dispersing medium, less than 5 percent by weight of the dispersing medium in the reaction vessel during nucleation is provided by a gelatino-peptizer, and iodide ion is added concurrently with silver ion in an aqueous solution containing up to 12 mole percent iodide, based on total halide ion.

21. A process according to claim 20 further characterized in that gelatino-peptizer is present in the reaction vessel during nucleation containing less than 15 micromoles of methionine per gram and the pH of the reaction vessel during nucleation is maintained in the range of from 1.6 to 7.0.

22. A process according to claim 21 further characterized in that the concentration of gelatino-peptizer in the reaction vessel during nucleation is less than 0.05 percent of the dispersing medium, the pH within the reaction vessel when the gelatino-peptizer is present is in the range of 1.6 to 3.0, the pBr during the grain growth is maintained in the range of from 0.6 to 2.0, iodide ion in a concentration of up to 12 mole percent, based on total halide ion, is added concurrently with silver ion, and the molar ratio of of silver and halide ion addition rates during nucleation to that at the start of of grain growth is from 1 to 100.

23. A process according to claim 1 further characterized in that the rate of silver addition during nucleation is less than $1.00\times10^{-2}$ mole Ag/minute/liter of dispersing medium, the concentration of gelatino-peptizer in the reaction vessel during nucleation is less than 0.05 percent of the dispersing medium, the pH within the reaction vessel when the gelatino-peptizer is present is in the range of 1.6 to 3.0, the pBr during the grain growth is maintained in the range of from 0.6 to 2.0, iodide ion in a concentration of up to 12 mole percent, based on total halide ion, is added concurrently with silver ion, and the molar ratio of silver and halide ion addition rates during nucleation to that at the start of grain growth is from 1 to 50.

* * * * *